US007506461B2

(12) United States Patent
Jonninen

(10) Patent No.: US 7,506,461 B2
(45) Date of Patent: Mar. 24, 2009

(54) SCREENING, CRUSHING OR MIXING BUCKET

(75) Inventor: Markku Jonninen, Lahti (FI)

(73) Assignee: Allu Finland Oy, Orimattila (FI)

( * ) Notice: Subject to any disclaimer, the term of this patent is extended or adjusted under 35 U.S.C. 154(b) by 108 days.

(21) Appl. No.: 11/278,733

(22) Filed: Apr. 5, 2006

(65) Prior Publication Data

US 2006/0242864 A1 Nov. 2, 2006

(30) Foreign Application Priority Data

Apr. 6, 2005 (FI) ..... 20050116 U

(51) Int. Cl.
*E02F 3/40* (2006.01)
*E02F 2/96* (2006.01)

(52) U.S. Cl. ..... 37/403; 37/444; 37/341; 241/157

(58) Field of Classification Search ..... 37/444, 37/446, 403, 901, 903, 445, 379, 341; 241/236, 241/157

See application file for complete search history.

(56) References Cited

U.S. PATENT DOCUMENTS 3,959,897 A * 6/1976 May ..... 37/319
4,005,755 A * 2/1977 Bakke et al. ..... 172/32
4,113,023 A * 9/1978 Baskett ..... 171/63
5,060,732 A * 10/1991 Baskett ..... 171/63
5,084,991 A 2/1992 Cronk, Jr.
5,248,100 A * 9/1993 Arakawa ..... 241/34
5,379,534 A * 1/1995 Negishi ..... 37/379
5,394,912 A * 3/1995 Hume ..... 144/208.1
5,405,092 A * 4/1995 Jonninen ..... 241/27
5,485,689 A 1/1996 Jonninen
5,491,914 A * 2/1996 Negishi ..... 37/403
5,592,761 A * 1/1997 Ward ..... 37/403
5,619,811 A * 4/1997 Yrjola ..... 37/466
5,694,709 A * 12/1997 Cronk et al. ..... 37/142.5
5,992,483 A * 11/1999 Bohnke ..... 144/24.12

FOREIGN PATENT DOCUMENTS

FI 106931 B 5/2001
WO WO 01/58595 A1 8/2001

* cited by examiner

*Primary Examiner*—Thomas A Beach
(74) *Attorney, Agent, or Firm*—Sterne, Kessler, Goldstein & Fox P.L.L.C.

(57) ABSTRACT

The invention relates to a screening, crushing or mixing bucket.

2 Claims, 1 Drawing Sheet

SCREENING, CRUSHING OR MIXING BUCKET

BACKGROUND OF THE INVENTION

1. Field of the Invention

Figure 2:
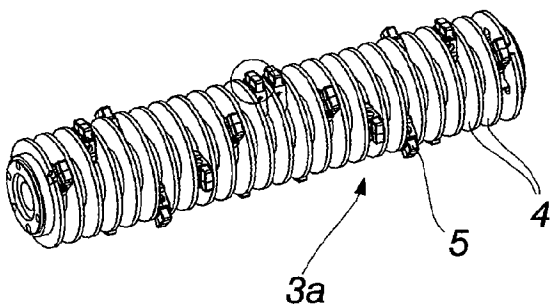

The invention relates to a screening, crushing or mixing bucket, comprising a body designed for use as the bucket of an excavating machine or a bucket loader, comprising a bottom plate and side walls, as well as screening, crushing or mixing elements located between a back portion of the bottom plate and a pivoting joint associated with a bucket boom, the mixing elements including working cylinders, which are rotatable about a shaft and which, while rotating, perform the screening, crushing or mixing of material contained in the bucket and at the same deliver screened, crushed or mixed material out of the bucket between or through working cylinders, as well as enclosures associated with the side walls for housing a drive mechanism and bearing assemblies for the working cylinders, the enclosures being located mainly between planes defined by the side walls, i.e. inside the bucket.

2. Background Art

Such a bucket is previously known from the Applicant's Finnish patent No. 106931. In this prior known bucket, the enclosures for a drive system and bearing assemblies are located outside the bucket's side walls in order to obviate a vaulting problem of the material flowing onto the working cylinders. Some prior art buckets, in which the drive enclosures are fitted inside the side walls, develop a problem of vaulting material. Enclosing a drive system always requires space in lateral direction as long as the cylinders have a horizontal axis of rotation. The enclosure is desirably made as narrow as possible, but the problem still remains with the well tapering towards the cylinders.

BRIEF SUMMARY OF THE INVENTION

It is an object of the invention to resolve said vaulting problem, even in the event that the enclosure for drive and bearing systems is located, at least for the most part, inside the bucket between the side walls. This object is accomplished by the invention on the basis of the characterizing features presented in the appended claim 1. When the enclosure for drive and bearing systems is designed inside the bucket for a two-way inclination relative to a plane defined by the working cylinders, the material to be processed will be capable of flowing in all circumstances onto the working cylinders at the bottom of the bucket instead of vaulting on the walls. In a bucket designed according to the invention, the drive enclosure has the bottom part of its front wall extended as close as possible to the rotary working cylinders and the top edge thereof as distant as possible from the cylinders. When the bucket is used for scooping material, the bottom edge of the casing, which is distant from the leading edge of the bucket's bottom plate, does not block the entrance of material into the bucket and, hence, filling the bucket is easy. When the bucket is swiveled to a working position, i.e. the working cylinders lie in an almost horizontal plane (10-20°), the material trickles first from its lowermost portion onto the cylinders without vaulting on the walls. The cylinders set the material in motion, thus providing a further anti-vaulting effect. In the upper portion of the bucket, wherein the drive enclosure only begins to narrow the internal width when it is further away from the cylinders, the side walls (enclosure walls) present in the proximity of the cylinders are straight, whereby no vaulting occurs there either, the operation being identical to a bucket that has its side walls straight and its drive enclosures outside the side walls.

In the event that the material nevertheless displays a tendency to vault along the edges of a drive enclosure, it can be readily dropped by a small movement of the bucket onto the bottom of the bucket for a clear passage to the cylinders. In addition, since the enclosure wall forms a trickling angle of at least 300 with respect to a normal of the side wall, the enclosure wall, being set in a two-way inclination, provides a steeply downward sloping surface, and so the material has no chance of vaulting in the working position or vaulting can be readily removed by a small movement of the bucket.

BRIEF DESCRIPTION OF THE DRAWINGS/FIGURES

Figure 1:
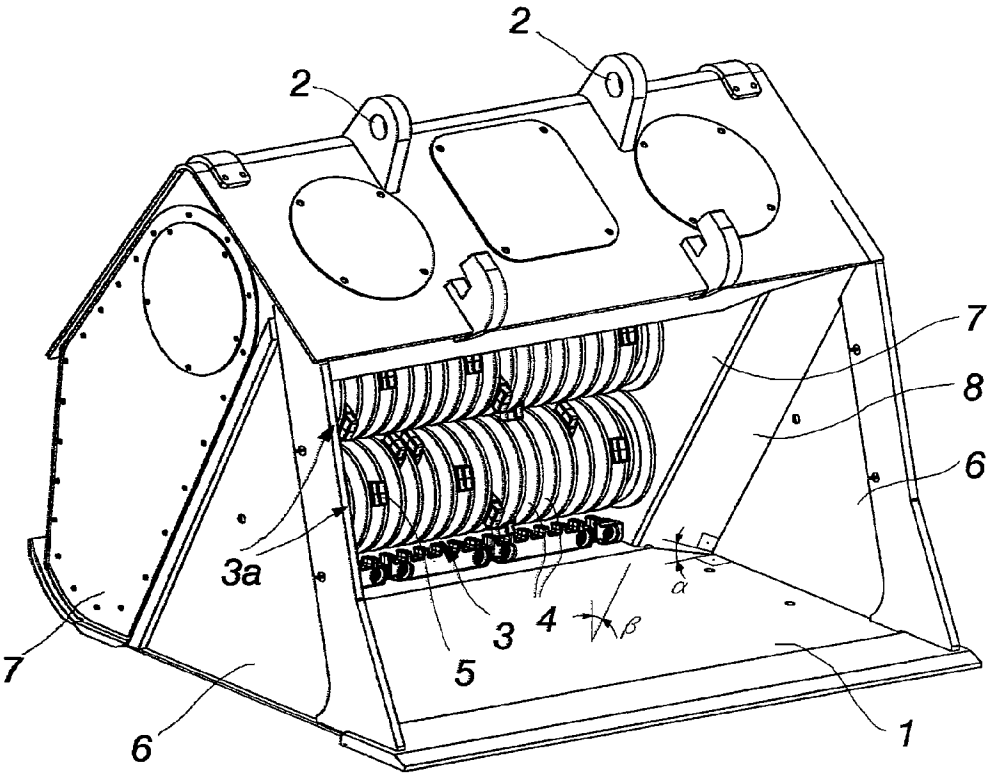

The invention will now be illustrated by way of an exemplary embodiment with reference to the accompanying drawing, in which FIG. 1 shows a bucket of the invention in a perspective view obliquely from the front, and FIG. 2 shows a working cylinder removed from the bucket.

DETAILED DESCRIPTION OF THE INVENTION

The invention will be described next in reference to a screen crusher, but depending on the choice of working cylinders, it can obviously be a screening, crushing or mixing bucket just as well.

The bucket body is designed for use as a bucket for an excavating machine or a bucket loader, comprising a bottom plate 1, side walls 6 and screening, crushing or mixing elements 3, including working cylinders 3*a*, which are rotatable about a shaft and which, while rotating, perform the screening, crushing or mixing of stuff contained in the bucket and at the same deliver screened, crushed or mixed stuff out of the bucket between or through working cylinders 3*a*. The working cylinders 3*a* are located in a zone between a back portion of the bottom plate 1 and a pivoting joint 2 associated with the bucket boom. The side walls 6 are provided with enclosures 7 for housing a drive mechanism and bearing assemblies for the working cylinders 3*a*. The enclosures 7 are located mainly between planes defined by the side walls 6, i.e. inside the bucket.

The enclosure walls 8, which make the bucket well narrower in the direction from the mouth towards the working cylinders 3*a*, are set in a two-way inclined orientation relative to a plane extending by way of the working cylinders' 3*a* shafts. The first orientation (angle $\beta$) is established in such a way that the enclosure wall 8 has its bottom end, which is towards the base plate 1, lying substantially closer to a plane defined by the working cylinders 3*a* than the enclosure wall's 8 top end. The second inclined orientation (angle $\alpha$) is established in such a way that the angle between the enclosure wall 8 and a normal of the side wall 6 is at least 30°, preferably at least 40°. As a result, the material being screened, crushed or mixed does not become vaulted on the bucket.

The bucket shown in the drawing comprises a screen crusher, the working cylinder 3*a* of which includes axially spaced-apart screening disks 4 with intervening replaceable tool blocks 5 for crushing the material to be processed. The tool blocks 5 have a radial dimension exceeding that of the screening disks 4 and the working cylinders 3*a* are set so close to each other that the screening disks 4 almost touch (or indeed touch) each other, whereby the tool blocks 5 end up between the screening disks 4 of the adjacent working cylinder.

The invention claimed is:

1. A screening, crushing or mixing bucket, comprising a body designed for use as a bucket for an excavating machine or a bucket loader, comprising a bottom plate (1) and side walls (6), as well as screening, crushing or mixing elements (3, 3*a*, 4, 5) located between a back portion of the bottom plate (1) and a pivoting joint (2) associated with the bucket boom, the mixing elements including working cylinders (3*a*), which are rotatable about a shaft and which, while rotating, perform the screening, crushing or mixing of material contained in the bucket and at the same deliver screened, crushed or mixed material out of the bucket between or through working cylinders (3*a*), as well as enclosures (7) associated with the side walls for housing a drive mechanism and bearing assemblies for working cylinders (3*a*), the enclosures (7) being located mainly between planes defined by the side walls (6), such that the enclosures (7) are inside the bucket, characterized in that it has enclosure walls (8), which make the bucket well narrower in an axial direction of the working cylinders (3*a*) when going in the direction from a mouth of the bucket towards the working cylinders (3*a*), each set in a two-way inclined orientation relative to a plane extending by way of the working cylinders' (3*a*) shafts, such that a bottom end of the enclosure wall (8), which is towards a bottom plate (1), lies substantially closer to a plane defined by the working cylinders (3*a*) than a top end of the enclosure wall, and that an angle ($\alpha$) between the enclosure wall (8) and a normal of the side wall (6) is at least 30°, preferably at least 40°.

2. A bucket as set forth in claim 1, characterized in that the bucket comprises a screen crusher, the working cylinders (3*a*) of which include axially spaced-apart screening disks (4) with intervening replaceable tool blocks (5) for crushing the material to be processed, the tool blocks (5) extending radially beyond the screening disks (4) and reaching between the screening disks (4) of the adjacent working cylinder (3*a*).

* * * * *